United States Patent [19]

Abe et al.

[11] Patent Number: 4,477,319

[45] Date of Patent: Oct. 16, 1984

[54] PROCESS FOR FORMING A FERRITE FILM

[75] Inventors: Masanori Abe, Tokyo; Yutaka Tamaura, Yokohama, both of Japan

[73] Assignees: Denki Kagaku Kogyo Kabushiki Kaisha; Mitsubishi Chemical Industries Ltd., both of Tokyo, Japan

[21] Appl. No.: 559,369

[22] Filed: Dec. 8, 1983

[30] Foreign Application Priority Data

Dec. 15, 1982 [JP] Japan ..... 57-219741

[51] Int. Cl.[3] ..... C25D 11/02

[52] U.S. Cl. ..... 204/56 R; 427/130; 428/900

[58] Field of Search ..... 204/38 A, 56 R, 130; 427/130; 428/900

[56] References Cited

U.S. PATENT DOCUMENTS 2,582,590 1/1952 Heeren et al. ..... 427/130

3,703,411 11/1972 Melezoglu ..... 427/130

*Primary Examiner*—R. L. Andrews

*Attorney, Agent, or Firm*—Oblon, Fisher, Spivak, McClelland & Maier

[57] ABSTRACT

A process for forming a ferrite film, which is characterized in that in an aqueous solution containing at least ferrous ions as metal ions, ferrous hydroxide ions $FeOH^+$, or $FeOH^+$ and other metal hydroxide ions, are uniformly adsorbed on the surface of a solid by an interfacial reaction at an interfacial boundary between the solid and the aqueous solution; and the adsorbed $FeOH^+$ is oxidized to $FeOH^{2+}$, whereupon $FeOH^{2+}$ and metal hydroxide ions in the aqueous solution undergo a ferrite crystallization reaction to precipitate a ferrite layer on the surface of the solid.

7 Claims, 5 Drawing Figures

(a)

(b)

PROCESS FOR FORMING A FERRITE FILM

The present invention relates to a process for producing a spinel-structured ferrite layer containing $Fe^{3+}$, which is widely used for a magnetic recording medium, a photomagnetic recording medium, a magnetic head, a magneto-optic device, a microwave device, a magnetostriction device or a magneto-acoustic device. More particularly, the present invention relates to a process for forming a spinel-structured crystalline ferrite layer on the surface of a solid, whether the solid is metal or nonmetal, by means of a chemical or electrochemical method in an aqueous solution without requiring heat treatment at a high temperature (300° C. or higher).

Heretofore, the preparation of a ferrite layer has been conducted either by a coating or sheeting method wherein a binder is used or by a method wherein no binder is employed. The ferrite layer formed by the coating method is presently widely used for magnetic tapes or magnetic discs. However, it has restrictions such that (a) due to the presence of the nonmagnetic binder among ferrite particles, the magnetic recording density is low, and it is not useful for an device such as a magneto-optic device, a magnetostriction device or a magneto-acoustic device where polycrystal is required, and (b) since the configurational anisotropy of ferrite particles is utilized to obtain the magnetic anisotropy of the layer, the material is restricted to $\gamma$-$Fe_2O_3$ or $Fe_3O_4$ which is available in the form of fine acicular particles. Whereas, the ferrite layer obtainable by the sheeting method has a low packing density of ferrite particles and is useful only as a thick layer of 1 mm or more for a wave absorber, and it is not useful for the above-mentioned various devices which require a high packing density. Thus, its application is limited.

On the other hand, for the preparation of a ferrite layer without using a binder, there have been known (1) solution coating method, (2) electrophoretic deposition method, (3) dry plating method such as sputtering, vacuum evaporation or arc discharge, (4) arc-plasma spray method, and (5) chemical vapour deposition method. In the methods (1) to (3), a layer is formed firstly in an amorphous state and then converted to a layer having a desired ferrite crystal structure. Accordingly, the methods (1) and (2) require heat treatment at a high temperature of 700° C., and the method (3) requires heat treatment at a temperature of at least 300° C. even in the case where the ferrite contains only iron as the metal element and at a temperature as high as at least 700° C. in the case where the ferrite contains other metal elements in addition to iron. In the method (4), the substrate must be kept at a temperature of at least 1000° C. during the layer forming operation. Likewise, in the method (5), the substrate is required to be a single crystal of an oxide having a high melting point. Thus, in each of these methods, there has been a restriction that it is impossible to use a material having a low melting point or low decomposition temperature as the substrate.

Under the circumstances, the present inventors have conducted various researches to develop a method for forming a ferrite film which, as opposed to the conventional methods for the preparation of the ferrite films, does not require heat treatment at a high temperature and has no special restriction with respect to the composition of the ferrite film or the type of the substrate, and have finally found that a crystalline ferrite film can be formed on various solid surfaces by using a method belonging to the category of wet plating which used to be regarded as applicable only for a metal or an alloy and as incapable of forming a layer of an metal oxide. The present invention is based on this discovery.

Namely, the present invention provides a process for forming a ferrite film, which is characterized in that in an aqueous solution containing at least ferrous ions as metal ions, ferrous hydroxide ions $FeOH^+$, or $FeOH^+$ and other metal hydroxide ions, are uniformly adsorbed on the surface of a solid by a reaction on the surface of the solid utilizing a surface activity at the interfacial boundary between the solid and the aqueous solution, and the adsorbed $FeOH^+$ is oxidized to $FeOH^{2+}$ by an optional method, whereupon $FeOH^{2+}$ and metal hydroxide ions in the aqueous solution undergo a ferrite crystallization reaction to deposit a uniform crystal ferrite on the surface of the solid.

The above-mentioned series of reactions to form a uniform crystallized ferrite layer will be hereinafter referred to as a "ferrite layer-forming reaction".

The ferrite film thus obtained, is firmly bonded on the solid surface and is hardly peeled from the surface, and its composition and magnetic properties are suitable for application for the above-mentioned purposes. According to the present invention, the layer-forming can be applied to various solid substrates whether they are metal or nonmetal, if they satisfy the condition that they are stable in the aqueous solution.

In the case where the above-mentioned aqueous solution contains $Fe^{2+}$ ions as the metal ions, the ferrite layer of the present invention will be a spinel ferrite layer containing only iron as the metal element, i.e. a layer of magnetite $Fe_3O_4$ or maghemite $\gamma$-$Fe_2O_3$. Whereas, in the case where the aqueous solution contains $Fe^{2+}$ ions and other transitional metal ions M ($M=Zn^{2+}$, $Co^{2,3+}$, $Ni^{2+}$, $Mn^{2,3+}$, $Fe^{3+}$, $Cu^{2+}$, $V^{3,4,5+}$, $Sb^{5+}$, $Li^+$, $Mo^{4,5+}$, $Ti^{4+}$, $Rd^{3+}$, $Mg^{2+}$, $Al^{3+}$, $Si^{4+}$, $Cr^{3+}$, $Sn^{2,4+}$ or the like), there will be obtained a ferrite layer containing iron and other metal elements. For instance, when M is one kind, there will be obtained a layer of cobalt ferrite ($Co_xFe_{3-x}O_4$), nickel ferrite ($Ni_xFe_{3-x}O_4$), etc. Likewise, when M represents a plurality of different metal ions, there will be obtained a layer of mixed crystal ferrite such as Mn-Zn ferrite ($Mn_xZn_yFe_{3-x-y}O_4$), etc. Thus, the present invention is applicable to the preparation of such a variety of layers.

Further, the present invention is applicable not only to the preparation of a thin film having a thickness of from some 10A to some 100 m but also to the preparation of a thick film having a thickness of from 0.1 to 3 mm or more. If necessary, the ferrite layer-forming reaction can be conducted continuously.

Now, the present invention will be described in detail with reference to the preferred embodiments.

In the accompanying drawings, each of FIGS. 1(*a*) and (*b*) is a view showing a state in which a substrate with its surface having a surface activity for the aqueous solution is immersed in the solution.

FIG. 2 is a view illustrating a manner in which the oxidation is conducted.

Each of FIGS. 3(*a*) and (*b*) is a view illustrating a manner to form a gas/liquid interface on the substrate surface.

Figure 1:
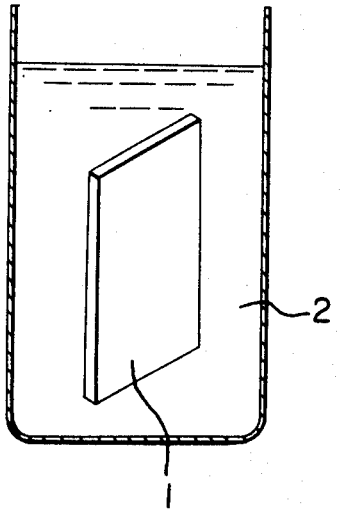
Figure 1:
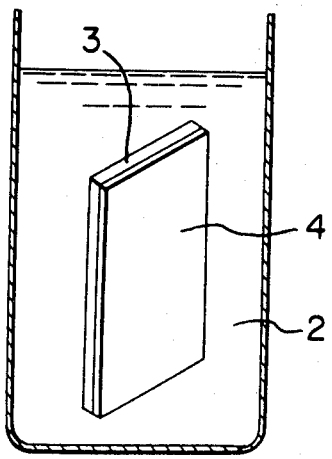

The aqueous solution to be used in the present invention may be obtained by dissolving a ferrous salt such as ferrous chloride $FeCl_2$ or such a ferrous salt and a salt of other metal element in water, or obtained by dissolving metal iron with an acid. This aqueous solution is preferably adjusted to have a pH of at least 6.5, more preferably at least 8.

When a solid substrate with its surface uniformly surface-activated (hereinafter referred to simply as a "substrate") is immersed in such an aqueous solution containing at least $FeOH^+$, $FeOH^+$ will be adsorbed uniformly on the surface of the substrate. This may be represented by the following chemical formula (i):

$$FeOH^+ \rightarrow FeOH^+\text{—(solid)} \quad \text{(i)}$$

In a case where the aqueous solution contains ferrous ions in a form other than $FeOH^+$, i.e. in a form of $FeA_\beta^{+(2-\alpha\beta)}$ (where A is an anion having a valence $\alpha$, for instance, in the case of $SO_4^{2-}$, $\alpha=2$ and $\beta=1$), and the reaction of the above formula (i) is conducted by hydrolysis represented by the following formula:

$$FeA_\beta^{+(2-\alpha\beta)} + H_2O \rightarrow FeOH^+\text{—(solid)} + H^+ + \beta A^{-\alpha},$$

the pH of the aqueous solution gradually decreases as the hydrolysis proceeds. Accordingly, in order to conduct the ferrite layer-forming reaction under a constant predetermined condition, an optional means is employed to maintain the pH at a constant level.

The substrate surface is "surface activated" for the adsorption of $FeOH^+$. This means that the substrate may have such a property as its intrinsic property, or such a substance may be deposited or formed on the surface of the substrate, or a gas/liquid interface may be present. A further description on this point will be given hereinafter.

Then, $FeOH^+$ uniformly adsorbed on the substrate surface is oxidized as shown in the following formula (ii):

$$FeOH^+\text{—(solid)} \rightarrow FeOH^{2+}\text{—(solid)} \quad \text{(ii)}$$

whereby a uniform $FeOH^{2+}$ layer will be formed on the substrate surface. $FeOH^{2+}$ thus formed on the substrate surface, will then react with $FeOH^+$ in the aqueous solution, or further with other metal hydroxide ions $MOH^{+(n-1)}$ to undergo a ferrite crystallization reaction represented by the following formula (iii), whereby ferrite crystals will be formed:

$$xFeOH^{2+}\text{—(solid)} + yFeOH^+ + zMOH^{+(n-1)} \rightarrow (Fe_x^{3+}, Fe_y^{2+}, M_z^{n+})O_4\text{—(solid)} + 4H^+ \text{(where } x+y+z=3) \quad \text{(iii)}$$

As mentioned above with respect to the formula (i), if $FeOH^+$ is uniformly adsorbed on the substrate surface to form a uniform layer of $FeOH^+$—(solid), the ferrite crystals will likewise uniformly formed by the reactions of the formulas (ii) and (iii). The ferrite crystal layer thus formed, by itself, has a uniform surface activity for the adsorption of $FeOH^+$, and accordingly $FeOH^+$—(solid) will further be formed on the crystal layer by the adsorption reaction of the formula (i). Thus, by continuously conducting the oxidation reaction of the formula (ii), the ferrite layer will be gradually and uniformly grown and deposited on the substrate surface, whereby a ferrite layer having an optional thickness can be obtained.

In the above-mentioned reactions, if the aqueous solution contains other metal ions in addition to the ferrous ions, the first layer of ions adsorbed on the surface of the substrate will contain $FeOH^+$ and other metal hydroxide ions, whereby ferrite crystals containing Fe and other elements will grow from the initial stage of the ferrite layer-forming reaction represented by the formulas (i), (ii) and (iii). The ferrite layer thus obtained is adequately qualified for practical application for the intended purposes. However, in order to obtain a more uniform layer, it is advisable to follow the following method.

Namely, the adsorptive power of $FeOH^{2+}$ on the substrate is extremely strong, and it is accordingly advisable that firstly $FeOH^+$ alone is adsorbed on the substrate surface to form a uniform magnetite layer as the first layer, and then a ferrite containing additional metal elements is grown on such a uniform magnetite layer.

Further, during the process of the ferrite layer-forming reaction, it is likely that fine particles precipitate in the aqueous solution and they tend to adversely affect the the uniform ferrite layer growth on the substrate surface. In order to prevent the deposition of such fine particles, it is effective to give vibrations to the interfacial boundary between the solid and the aqueous solution by e.g. placing the aqueous solution vessel on a vibration apparatus or giving vibrations directly to the solid or the aqueous solution.

The ferrite layer-forming reaction will usually proceed satisfactorily at a reaction temperature of about room temperature or higher, although it depends upon the desired reaction rate. If necessary, the reaction rate may be increased by employing a still higher temperature.

Now, the surface activity of the substrate surface on which $FeOH^+$ in the aqueous solution is adsorbed, will be described. In this respect, as shown in FIG. 1(*a*), the substrate may be a solid 1 to be immersed in the aqueous solution 2, which intrinsically posseses a surface activity for the adsorption of $FeOH^+$, or as shown in FIG. 1(*b*) the substrate may be a solid 3 which per se does not have such an intrinsic property but which is provided on an appropriate surface with a coating (bonded or deposited) of a surface active substance 4. As such a surface active solid 1 or substance 4, there may be mentioned an alloy containing iron, such as stainless steel, an iron oxide (for instance magnetite, $\gamma$-$Fe_2O_3$, $\alpha$-$Fe_2O_3$, ferrite, etc.), a noble metal such as gold, platinum or palladium, a saccharide having OH groups such as cane suger or cellulose (for instance, in a form of a film or as deposited on a solid surface), or base metal ions such as nickel or copper ions (as deposited on a solid surface). Among the above-mentioned substances, the noble metal et seq. have not only the surface activity for the adsorption of $FeOH^+$ but also a catalytic activity for the oxidation of $FeOH^+$ in the reaction of the formula (ii). The substrates shown in FIGS. 1(*a*) and (*b*) are alike in that, in each case, the substrate surface has a surface activity. However, according to the method of FIG. 1(*b*), it is possible to impart the surface activity to any optional substrate. Thus, this method is extremely useful in that a variety of plastic films may be used as the substrate so long as they are stable in the aqueous solution.

Further, instead of utilizing the specific property of the material constituting the surface layer of the substrate, the surface activity may be imparted to the substrate surface by forming a gas/liquid interface on the surface of the solid, whereby the surface activity for the adsorption of $FeOH^+$ can be imparted irrespective of the type or nature of the substrate. Thus, another embodiment of the present invention is available based on this principle.

Figure 3:
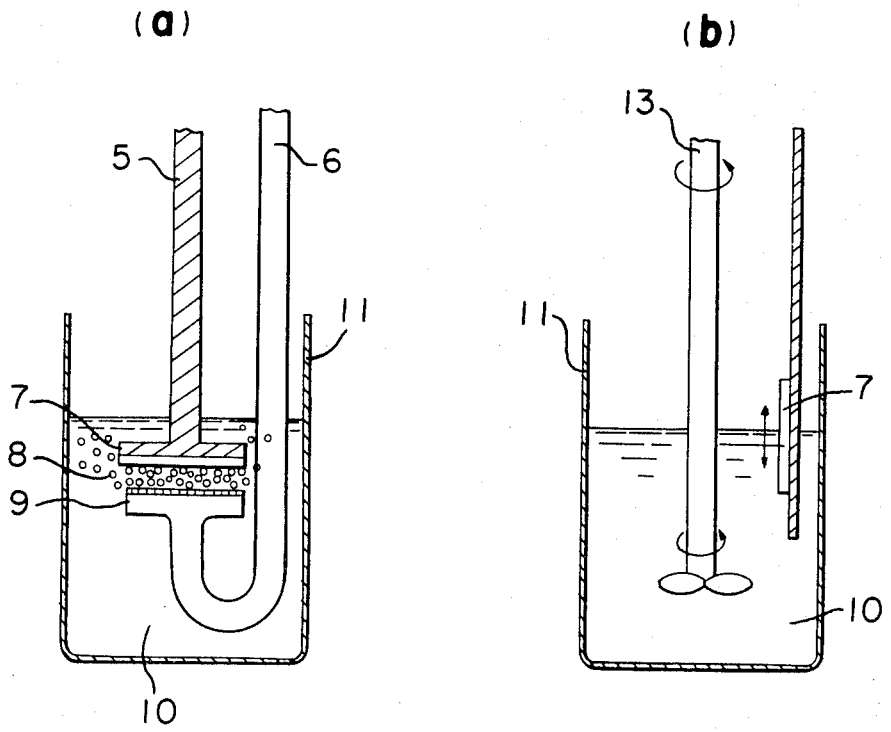

For instance, the gas/liquid interface may be formed on the solid surface as shown in FIG. 3(*a*), wherein a tiny bubble-forming section 9 is disposed to face a substrate 7 supported by a substrate support 5 and immersed in a predetermined aqueous solution 10, and bubbles 8 blown out from the tiny bubble-forming section 9 are impinged to the substrate 7. Reference numeral 11 designates the reaction vessel.

If a nitrogen gas is used for the bubbles, the surface activity for the adsorption can be imparted. Further, if air or oxygen gas is employed, it is possible to simultaneously form an oxidizing atmosphere on the substrate surface. Accordingly, for the practical purpose, it is advantageous to use air as the gas. On this point, a further description will be given hereinafter.

The substrate which adsorbs $FeOH^+$ may have a flat surface or a surface of any other configuration. Likewise, the surface condition may optionally be selected to have a desired smoothness.

Now, the oxidation reaction of $FeOH^+$ adsorbed on the substrate, as represented by the formula (ii), will be described.

As mentioned above, the noble metals, saccharides or base metal ions exhibit not only the surface activity for the adsorption but also the catalytic acitivity for the oxidation of $FeOH^+$. Accordingly, if the substrate surface is made of such a material, oxidation proceeds simultaneously with the adsorption of $FeOH^+$ from the aqueous solution onto the substrate surface.

However, such a catalytic activity for the oxidation will be lost as the ferrite crystal layer grows. Therefore, for further growth of the layer or when a substrate having no catalytic activity for the oxidation is employed, a separate oxidizing means will be required.

Figure 2:
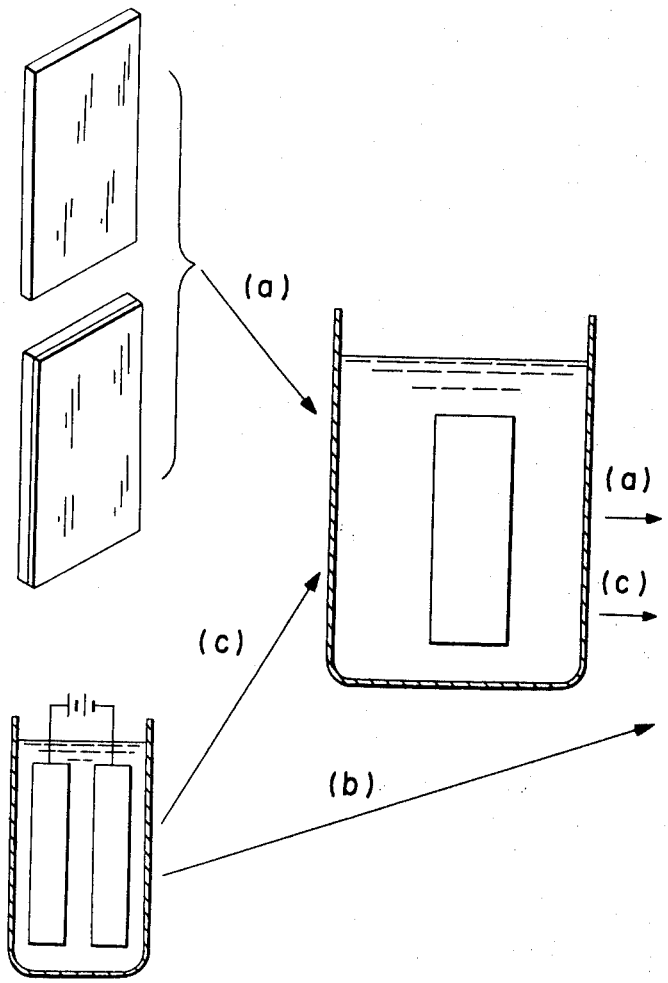

FIG. 2 illustrates three different operations for this oxidation. In the operation (a), a substrate with a surface having the catalytic activity for the adsorption of $FeOH^+$ (including a case where the oxidation catalytic activity of the substrate has been lost as a result of the formation of the ferrite crystal layer) is immersed in the aqueous solution, and it is subjected to oxidation by a chemical oxidation method to form a ferrite layer.

Here, the chemical oxidation method is meant for a known method wherein oxygen or hydrogen peroxide is employed, a highly oxidative acid or salt such as nitric acid is added to the aqueous solution, or $\gamma$-ray (e.g. $Co^{60}$) is irradiated.

In the operation (b) in FIG. 2, an anode oxidation method is employed. In the case where the anode oxidation method is employed, however, if the aqueous solution contains metal ions other than $FeOH^+$, the resulting ferrite layer becomes to be electrically non-condcutive, and accordingly the thickness of the layer will be limited to a level of at most 0.1 $\mu$m. Therefore, a layer having any optional thickness may be obtained by this method only when the aqueous solution contains only ferrous ions as the metal ions and the resulting ferrite crystals are $Fe_3O_4$.

Further, if a chemical oxidation method is employed after the anode oxidation, as illustrated in FIG. 2 by the operation (c), it is of course possible to obtain a ferrite layer having an optional thickness.

FIGS. 3(*a*) and (*b*) illustrate embodiments wherein the surface activity for the adsorption of the $FeOH^+$ on the substrate surface is provided by forming a gas/liquid interface on the substrate surface, and by employing air as the gas, $FeOH^+$ adsorbed on the substrate surface is simultaneously oxidized to $FeOH^{2+}$ without using any other oxidizing means. FIG. 3(*a*) illustrates an embodiment wherein air bubbles are continuously impinged to the substrate 7 immersed in the aqueous solution 10, as mentioned above. FIG. 3(*b*) illustrates another embodiment wherein the gas/liquid interface is formed on the substrate surface by moving the substrate 7 up and down with the surface level of the aqueous solution 10 being the center of the reciprocation movement. In the Figure, reference numeral 12 designates a supporting rod for the up-and-down movement of the substrate 7, and numeral 13 designates a stirrer.

According to these methods, various superior advantages are obtainable such that the substrate on which the ferrite layer is formed, is not required to have a surface active surface of its own, and yet no special oxidizing means other than air is required.

Further, the oxidation may be conducted in such a manner that firstly a substrate is dipped in an aqueous solution containing $FeOH^+$ and then withdrawn from the solution to form a thin liquid layer of the solution on the surface of the substrate, which is then contacted with an aqueous solution or gas containing an oxidizing agent by a suitable method such as spraying, blowing or otherwise applying the oxidizing solution or gas to the substrate, or dipping or placing the substrate in such an atmosphere. By this method, the oxidation of $FeOH^+$ is conducted only with respect to $FeOH^+$ contained in the thin liquid layer formed on the surface of the substrate. Thus, this method is advantageous over the above-mentioned method wherein the oxidation is conducted in an aqueous solution in that the contamination of the aqueous solution will be less as compared with the above-mentioned method.

This method will be described more specifically. Firstly, a thin layer of the aqueous solution containing $FeOH^+$ is formed on the surface of the substrate. This can readily be done by dipping the substrate in the aqueous solution and then withdrawing it from the solution, as mentioned above. However, in some cases, it is possible to employ other methods such as coating or spraying. There is no particular restrictions for the conditions under which the thin film of the aqueous solution is formed, so long as the entire surface of the necessary portions of the substrate can be wetted. For instance, in the case of the dipping method, the substrate may be immersed in the aqueous solution for from a few seconds to some ten seconds and then withdrawn.

The substrate thus formed with a thin layer of the aqueous solution, is then treated with an oxidizing agent such as an aqueous solution containing $NO_3^-$ or $H_2O_2$, an oxidative gas such as air or $O_2$, or water containing such an oxidative gas. This oxidation treatment is preferably conducted by spraying or blowing the above-mentioned oxidating agent to the substrate, whereby $FeOH^+$ in the thin layer of the aqueous solution formed on the substrate will be oxidized. Namely, metal ions such as $FeOH^+$ adsorbed on the substrate surface are thereby oxidized to form ferrite crystals.

The treating conditions may vary depending upon the intended use of the ferrite layer, the type or concentration of the oxidizing agent or the temperature, and may be selected appropriately depending upon the particular purpose. For instance, in the case where an air of a normal temperature is blown directly to the substrate, the blowing operation for from 30 seconds to 2 minutes is sufficient, and in the case where an aqueous solution containing $NO_3^-$ (about 0.03–0.05M) is sprayed to the substrate, the spraying operation for about 5 seconds is sufficient.

The ferrite layer formed by this method is of course very thin when formed in a single operation. Therefore, the operation is repeated until a desired thickness is obtained.

In repeating the operation, if the oxidizing agent is adhered to the surface of the substrate, a step of washing e.g. with water free from oxidizing reagent such as $O_2$ may be incorporated after each step of the application of the oxidizing agent.

In addition to the above-mentioned merit for the prevention of the contamination of the aqueous solution, this method also provides an advantage that as the ferrite is gradually and uniformly piled on the substrate, the surface of the ferrite layer can be finished to have a specular surface, which is desirable particularly for a magnetic recording medium.

As an additional unique effectiveness, it is noteworthy that when the oxidation treatment is conducted under stronger oxidizing conditions, the formed ferrite layer is further oxidized to form a $\gamma$-$Fe_2O_3$ layer.

In order to form $\gamma$-$Fe_2O_3$, the oxidizing conditions may be enhanced by controlling appropriate conditions such as the oxidation time, the oxidation temperature, the partial pressure of $O_2$ in the case where $O_2$ is used as the oxidizing agent, or the concentration of $NO_3^-$ in the case where $NO_3^-$ is used as the oxidizing agent. For instance, $\gamma$-$Fe_2O_3$ may be formed e.g. by oxidation by means of a gas mixture of steam and air at a temperature of at least 70° C., i.e. under stronger oxidizing conditions than those for the formation of the usual ferrite layer.

Now, the present invention will be described in further detail with reference to Examples. However, it should be understood that the present invention is by no means restricted to these specific Examples.

EXAMPLE 1

A polyimide film (thickness: 0.3 μm) surface-treated with a chromic acid mixed solution, is sequentially dipped in a stannous chloride solution and a palladium chloride solution to have palladium adsorbed on the film surface. This palladium has a surface activity as well as a property as an oxidation catalyst.

Then, in an aqueous solution containing $FeCl_2$ and $CoCl_2$ in a molar ratio of 2:1 and having a pH of 7.0 and a temperature of 65° C., the polyimide film treated as mentioned above, was immersed for 1 hour, whereupon a dark yellow, light-transmitting uniform thin layer (thickness: about 100 A) was formed on the film surface.

During the entire reaction process for the formation of the thin layer, the pH was maintained at a constant level by means of a pH stat (the same applies in the following Examples).

This thin film was firmly bonded and was not peeled off even when rubbed with fingers, and its electron diffraction pattern showed a Debye-Scherrer ring of a spinel ferrite. In the film, the metal ratio of Fe/Co=2.0±0.2. Thus, the film was found to be a cobalt ferrite ($CoFe_2O_4$) having substantially the stoichiometric composition.

EXAMPLE 2

In a ferrous sulfate solution having a pH of 8.0 and a temperature of 65° C., anode oxidation was conducted at a current of 0.01 mA/cm$^2$ for 3 hours by using a smooth surfaced stainless steel (SUS 304) substrate as the anode, whereby a uniform yellow thin film (thickness: about 5000 A) was formed on the substrate.

This layer was firmly bonded and was not peeled off even when rubbed with fingers, and its electron diffraction pattern showed a Debye-Scherrer ring of magnetite.

Then, this stainless steel substrate was immersed in an aqueous solution containing $FeCl_2$ and $CoCl_2$ in a molar ratio of 1:1 and having a pH of 7.0 and a temeprature of 65° C., and oxidized for 2 hours by air bubbling by an addition of sodium nitrate (0.02M) or by an addition of hydrogen peroxide (0.01M), as the oxidizing means, whereby a cobalt ferrite film of 1.5 μm, 0.8 μm or 2.1 μm was formed on the magnetite thin layer.

Figure 4:
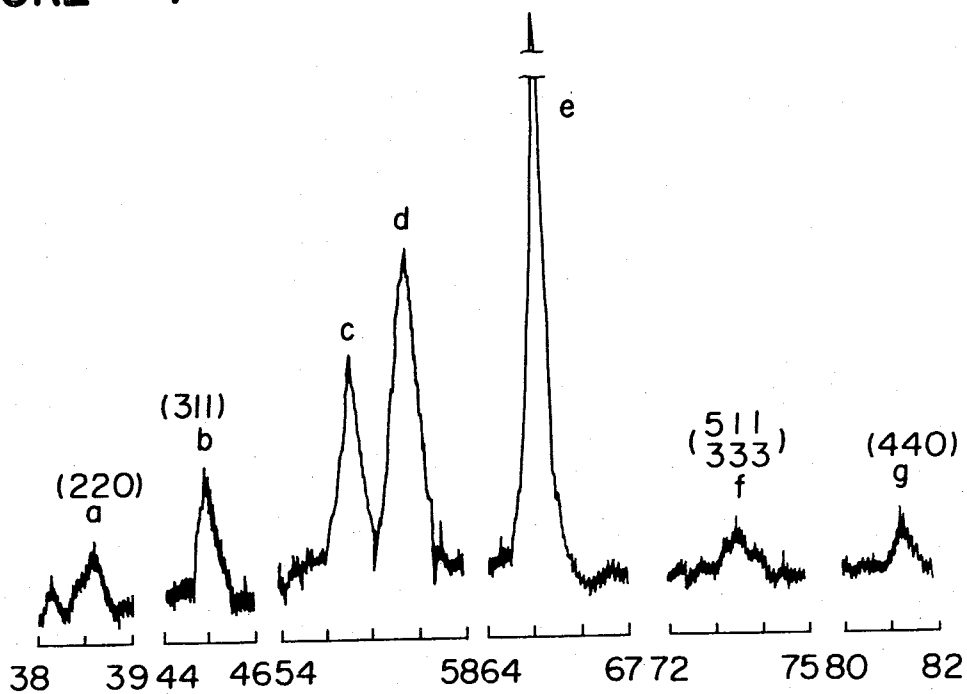
FIG. 4 shows an X-ray diffraction spectrum of the cobalt ferrite thin layer formed on a stainless steel substrate in Example 2, in which peaks a, b, f and g represent the cobalt ferrite and peaks c, d and e represent the stainless steel substrate.

Each of the three films thus obtained, showed an electron ray and X-ray diffraction patterns of the spinel crystals. FIG. 4 illustrates the X-ray diffraction pattern obtained by the air bubbling method, as an example.

From the chemical analysis, the cobalt ferrite layer was found to contain metal elements at a ratio of Fe/Co=2.0±0.2. Thus, the film was found to be cobalt ferrite $CoFe_2O_4$ having substantially the stoichiometric composition.

Figure 5:
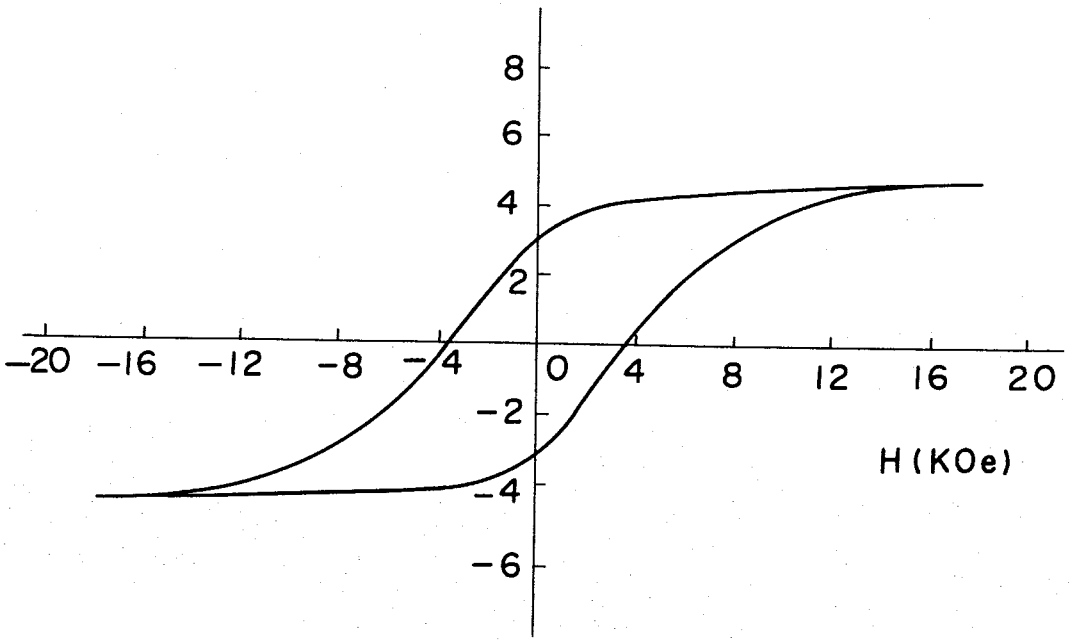
FIG. 5 is a view showing the magnetic field dependence of the polar Kerr rotation angle (hysteresis) of the ferrite thin film of FIG. 4.

FIG. 5 illustrates the magnetic field dependence of the polar Kerr rotation angle (hysteresis) of this film measured using a He-Ne laser beam of a wave length 0.63 μm. This hysteresis is rectangular, and the coercive force is as high as 3.4 KOe, thus indicating a possibility that this film has a vertical magnetic anisotropy.

EXAMPLE 3

A stainless steel substrate having a thin magnetite layer formed on its surface in the same manner as in Example 2, was immersed in an aqueous $FeCl_2$ solution having a pH of 11.0 and a temeprature of 95° C., and oxidized for 2 hours by an addition of sodium nitrate (0.05M), whereby a ferrite film (thickness: about 1.5 μm) was formed on the thin magnetite layer.

From the chemical analysis and X-ray diffraction, this ferrite film was found to have substantially a composition of $0.85Fe_2O_3-0.15Fe_3O_4$.

EXAMPLE 4

A quartz glass substrate (3 cm×5 cm) surface-treated with fluorine, was sequentially dipped in a stannous chloride solution and a palladium chloride solution, whereby palladium was adsorbed on the surface.

Then, in an aqueous solution containing $FeCl_2$, $NiCl_2$ and $CuCl_2$ in a molar ratio of 2:0.95:0.05 and having a pH of 7.0 and a temperature of 65° C., the quartz glass substrate thus treated was immersed for 30 minutes, whereby a uniform ferrite layer was formed as the first layer.

Then, air bubbling was conducted for 30 minutes, whereby a ferrite layer (thickness: 40 μm) was formed as the second layer. In this operation, the substrate was vibrated at a frequency of about 80 Hz and at an amplitude of about 5 mm by means of a low frequency vibrator.

From the chemical analysis, the ferrite layer thus obtained as the second layer was found to have a composition of $Ni_{0.95}$, $Cu_{0.05}$, $Fe_{2.0}$ and $O_{4.0}$.

Further, aluminum meander lines for generating and receiving elastic surface wave were evaporation-deposited on this ferrite film, and a pulse of 10.8 MHz was applied to the generating meander lines while applying an external magnetic field of 200 Oe in the wave propagation direction, whereby delayed pulses were detected by the receiving meander lines. When an alcohol was dropped in the propagation path, the delayed pulses disappeared. Thus, it was confirmed that delayed pulses were attributable to the Rayleigh waves. This indicates that this ferrite film is applicable to a delay element.

EXAMPLE 5

In an aqueous solution containing $FeCl_2$ and $CoCl_2$ in a molar ratio of 2:1 and having a pH of 8.0 and a temperature of 65° C., a Pyrex glass (trade mark; manufactured by Corning Company) plate was subjected to air bubbling for 2 hours in the manner as shown in FIG. 3(*a*), or the Pyrex glass plate was reciprocated for 2 hours (cycle: 0.5 seconds, reciprocating distance: about 5 cm) in the manner as shown in FIG. 3(*b*), whereby a dark yellow, light-transmitting uniform thin film (thickness: about 1.5 μm) was formed on the surface of the glass substrate.

The strength, X-ray diffraction pattern and composition of this thin film were substantially the same as those obtained in Examples 1 and 2.

Further, in this Example, a core of a quartz optical fiber was used instead of the Pyrex glass plate, whereby a dark yellow thin ferrite layer was formed on the surface of the core of the optical fiber in the same manner as above.

EXAMPLE 6

Iron was vapor-deposited in a thickness of about 300 A on a polyethylene terephthalate film, and then oxidized at 160° C. for 3 hours to form an iron oxide layer as the first layer. The film was then dipped in a $Fe^{2+}$ solution (i.e. 1 g of $FeCl_2.3H_2O$ was dissolved in 300 ml of water and the solution was adjusted to pH 7.0 and 70° C.) and then withdrawn from the solution to form a thin liquid layer. Then, a gas mixture of nitrogen and air in a ratio of 2:1 was blown thereto for about one minute in a reactor to which steam of 100° C. was supplied. Then, the film was washed with deaerated water, and again subjected to the thin liquid layer-forming operation and the gas mixture-blowing operation as mentioned above. The same operations were repeated 100 times, whereupon a ferrite layer having a thickness of 0.3 μm was obtained, which was firmly bonded to the film and hardly peeled by a finger nail. The chemical composition of the ferrite layer corresponded to magnetite, and from its electron diffraction pattern, it was found to be a spinnel structured compound. The same operations were repeated by using a reaction solution which was the same $Fe^{2+}$ solution as mentioned above except that 0.5 g of $CoCl_3.3H_2O$ was added to the solution, whereby a cobalt-ferrite film having a thickness of 0.4 μm and a composition of $CoFe_2O_4$ was formed. From the measurement of the magnetic characteristitics, each of these films was found to have special magnetic properties.

EXAMPLE 7

In the same manner as in Example 6, iron of about 300 A was vapor-deposited on a polyethylene terephthalate film, and then oxidized to form an iron oxide layer, and the film was dipped in a $Fe^{2+}$ solution (1 g of $FeCl_2.3H_2O$ was dissolved in 300 ml of water, and the solution was adjusted to pH 7.0 and 30° C.) and then withdrawn from the solution to form a thin liquid layer thereon. A gas mixture of nitrogen and air in a ratio of 10:1 was blown thereto for about 3 minutes. Then, the film was washed with deaerated water. The same operations were repeated 100 times, whereupon a film having a thickness of about 0.4 μm was obtained, which was firmly bonded to the polymer film and hardly peeled by a finger nail. From the chemical composition and the electron diffraction pattern, the film was found to be a magnetite film.

Titanium was vapor-deposited in a thickness of about 100 A on a polyethylene terephthalate film, and then oxidized at 180° C. for 6 hours to form a titanium oxide layer as the first layer. The same operations as mentioned above were repeated 100 times except that the titanium oxide layer was used instead of the iron oxide layer, whereby a magnetite film having a thickness of about 0.5 μm was formed. This film was firmly bonded to the polymer film and hardly peeled by a finger nail.

EXAMPLE 8

In the same manner as in Example 6, iron of about 300 A was vapor-deposited on a polyethylene terephthalate film, and then oxidized to form an iron oxide layer, and a thin liquid layer was deposited on the iron oxide layer. About 10 ml of a 0.05M sodium nitrate solution (80° C.) was sprayed thereto in a reactor to which steam of 100° C. was supplied. After leaving it to stand for one minute, the film was washed with 10 ml of distilled water, and a thin liquid layer was again deposited thereto. The same operations were repeated 100 times, whereupon a film having a thickness of about 0.6 μm was obtained, which was firmly bonded to the polymer film and hardly peeled by a finger nail. From the chemical analysis and the electron diffraction pattern, the film was found to be a magnetite film.

The same operations as above were repeated 100 times by using a 0.1% hydrogen peroxide aqueous solution (25° C.) instead of the above-mentioned sodium nitrate solution, whereupon a strong ferrite film having a thickness of about 0.5 μm was formed. From the chemical analysis, this film was found to be a layer of solid solution of $\gamma$-$Fe_2O_3$ and $Fe_3O_4$ (0.6 $\gamma$-$Fe_2O_3$.0.4$Fe_3O_4$).

EXAMPLE 9

In the same manner as in Example 6, iron of about 300 A was vapor-deposited on a polyethylene terephthalate film, and then oxidized to form an iron oxide layer, and a thin liquid layer was depsited on the iron oxide layer. The temperature of the $Fe^{2+}$ solution was 70° C. About 100 ml of hot water of 80° C. saturated with oxygen by preliminarily blowing an adequate amount of air thereto, was flowed on the thin liquid film in a reactor to which steam of 100° C. was supplied. The film was washed with distilled water, and then again dipped in the $Fe^{2+}$ solution and withdrawn to form a thin liquid layer. These operations were repeated about 1000 times. The film obtained by this method was firmly bonded to the polymer film and hardly peeled by a finger nail, and its surface was as smooth as a specular surface. The thickness of the film was 0.4 μm, and from the chemical analysis, this film was found to be composed of γ-$Fe_2O_3$.

Likewise, when the temperature of the $Fe^{2+}$ solution was changed to 30° C., a similar γ-$Fe_2O_3$ layer having a thickness of 0.3 μm was formed.

Further, the same operations as above were repeated about 1000 times by using a nitric acid ion solution of 80° C. with 0.05 M sodium nitrate dissolved therein, instead of the oxygen-saturated hot water, i.e. by flowing about 50 ml of the nitric acid ion solution on the thin liquid layer, followed by washing with about 100 ml of distilled water, whereby a γ-$Fe_2O_3$ film was formed which had a thickness of 0.6 μm and similarly extremely good quality.

Likewise, when the same operations as above were repeated by using the same substrate as used in Example 7 i.e. a polyethylene terephthalate film with titanium oxide formed thereon, a γ-$Fe_2O_3$ film was formed which had a thickness of 0.5 μm and similarly good quality.

During the whole operations in Examples 6 to 9, no formation of precipitates in the $Fe^{2+}$ solution was observed, and the solution was capable of being reused in each case of Examples 6 to 9.

EXAMPLE 10

The same operations as in Examples 6 to 9 were conducted by using a polyethylene terephthalate film with the surface cleaned with trichlene or a cleaning agent. In each case, a ferrite film having a thickness of from 0.4 to 0.6 μm was formed.

Likewise, when the same operations as in Examples 6 to 9 were conducted by using a polymer film of polycarbonate or polyimide with its surface treated in the similar manner, a ferrite film was formed in each case.

EXAMPLE 11

Titanium was vapor-deposited in a thickness of about 100 A on a polyethylene terephthalate film, and then oxidized at 180° C. for 16 hours in air to form a titanium oxide layer. The film was suspended in a one liter reactor, and 10 ml of each of a $Fe^{2+}$ solution (1 g of $FeCl_2.3H_2O$ was dissolved in 300 ml of water and the solution was adjusted to pH 7.0 and 30° C.) and a 0.03 M sodium nitrate solution of 80° C. was alternately sprayed to the surface of the film in a total of 1000 times, whereupon a γ-$Fe_2O_3$ film having a thickness of about 0.3 γm was formed.

We claim:

1. A process for forming a ferrite film, which is characterized in that in an aqueous solution containing at least ferrous ions as metal ions, ferrous hydroxide ions $FeOH^+$, or $FeOH^+$ and other metal hydroxide ions, are uniformly adsorbed on the surface of a solid by an interfacial reaction at an interfacial boundary between the solid and the aqueous solution; and the adsorbed $FeOH^+$ is oxidized to $FeOH^{2+}$, whereupon $FeOH^{2+}$ and metal hydroxide ions in the aqueous solution undergo a ferrite crystallization reaction to deposit a ferrite layer on the surface of the solid.

2. The process for forming a ferrite film according to claim 1, wherein at least the surface layer of the solid is made of a substance having a surface activity for adsorption of $FeOH^+$.

3. The process for forming a ferrite film according to claim 1, wherein a gas/liquid interface is formed on the surface of the solid to provide a surface activity for adsorption.

4. The process for forming a ferrite film according to claim 1, wherein at least the surface layer of the solid is made of a substance having a surface activity for adsorption of $FeOH^+$ and a catalytic activity for the oxidation reaction.

5. The process for forming a ferrite film according to claim 1, wherein the oxidation of $FeOH^+$ is conducted by a chemical or electrochemical method.

6. The process for forming a ferrite film according to claim 3, wherein the gas/liquid interface is formed on the surface of the solid by using a gas containing oxygen, to provide an oxidizing effect as well as a surface activity for adsorption.

7. A process for forming a ferrite film, which is characterized in that in an aqueous solution containing at least ferrous ions as metal ions, ferrous hydroxide ions $FeOH^+$, or $FeOH^+$ and other metal hydroxide ions, are uniformly adsorbed on the surface of a solid by an interfacial reaction at an interfacial boundary between the solid and the aqueous solution, and the adsorbed $FeOH^+$is oxidized to $FeOH^{2+}$, whereupon $FeOH^{2+}$ and metal hydroxide ions in the aqueous solution undergo a ferrite crystallization reaction, the above series of reactions being conducted while imparting vibrations to the interfacial boundary between the solid and the aqueous solution.

* * * * *